US009995137B2

(12) United States Patent
O'Neill et al.

(10) Patent No.: US 9,995,137 B2
(45) Date of Patent: Jun. 12, 2018

(54) SERVICE TOOL FOR CUTTING BIT ASSEMBLY

(71) Applicant: Joy MM Delaware, Inc., Wilmington, DE (US)

(72) Inventors: Michael L. O'Neill, Lucinda, PA (US); Randy W. Arnold, Harrisville, PA (US)

(73) Assignee: Joy Global Underground Mining LLC, Warrendale, PA (US)

( * ) Notice: Subject to any disclaimer, the term of this patent is extended or adjusted under 35 U.S.C. 154(b) by 458 days.

(21) Appl. No.: 14/855,267

(22) Filed: Sep. 15, 2015

(65) Prior Publication Data

US 2016/0076371 A1 Mar. 17, 2016

Related U.S. Application Data

(60) Provisional application No. 62/050,425, filed on Sep. 15, 2014.

(51) Int. Cl.

| | |
|---|---|
| ***B25B 1/00*** | (2006.01) |
| ***E21C 35/197*** | (2006.01) |
| *E21C 35/18* | (2006.01) |

(52) U.S. Cl.

CPC .... *E21C 35/197* (2013.01); *E21C 2035/1826* (2013.01)

(58) Field of Classification Search

CPC .... B25B 1/00; B25B 3/00; B25B 5/00; B25B 1/20

See application file for complete search history.

(56) References Cited

U.S. PATENT DOCUMENTS

| | | | |
|---|---|---|---|
| 5,738,415 | A | 4/1998 | Parrott |
| 6,059,373 | A | 5/2000 | Wright et al. |
| 8,020,941 | B2 | 9/2011 | Latham |

(Continued)

FOREIGN PATENT DOCUMENTS

| | | |
|---|---|---|
| AU | 716518 B2 | 2/2000 |
| PL | 350271 | 5/2003 |

OTHER PUBLICATIONS

PCT International Search Report and Written Opinion for Application No. PCT/US2015/050277 dated Nov. 16, 2015 (9 pages).

(Continued)

*Primary Examiner* — Lee D Wilson
(74) *Attorney, Agent, or Firm* — Michael Best & Friedrich LLP

(57) ABSTRACT

A tool includes an actuator assembly, a rod, a first nut, and a second nut. The actuator assembly includes a cylinder, a ram, and a bore extending through the cylinder and the ram. The cylinder includes an internal chamber supporting the ram, a first end, a second end, and a reaction surface positioned proximate the first end. The ram is movable relative to the cylinder and positioned adjacent the second end of the cylinder. The rod extends through the bore of the actuator assembly. The first nut is selectively coupled to one of a first end of the rod and a second end of the rod, and defines a first dimension larger than the bore width of the bit block. The second nut is selectively coupled to the other of the first end of the rod and the second end of the rod, and defines a second dimension less than the bore width.

22 Claims, 16 Drawing Sheets

(56) References Cited

U.S. PATENT DOCUMENTS

| | | | | |
|---|---|---|---|---|
| 8,601,662 | B1 | 12/2013 | Rankin | |
| 8,661,640 | B2 | 3/2014 | Parrott | |
| 2002/0145243 | A1* | 10/2002 | Shibata | B25B 5/006 269/25 |
| 2002/0153175 | A1 | 10/2002 | Ojanen | |
| 2009/0283948 | A1* | 11/2009 | Fukui | B25B 5/122 269/32 |
| 2010/0038955 | A1 | 2/2010 | Keller et al. | |
| 2010/0320829 | A1 | 12/2010 | Sollami | |
| 2011/0181098 | A1 | 7/2011 | Zimmerman et al. | |
| 2011/0241407 | A1 | 10/2011 | Fader et al. | |
| 2014/0103589 | A1* | 4/2014 | McIntosh | B25B 5/087 269/32 |
| 2016/0076371 | A1* | 3/2016 | O'Neill | E21C 35/197 299/10 |

OTHER PUBLICATIONS

Semper A. Porebski, BOCHNIA<http://www.semper-bochnia.pl/katalogi/noze_gomicze_i_drogowe.pdf>webpage (cited in Polish Search Report).

Polish Patent Office Search Report for Application No. P.422298 dated Nov. 30, 2017 (3 pages with Statement of Relevance).

* cited by examiner

Sleeve Install Mode

Sleeve Removal Mode

SERVICE TOOL FOR CUTTING BIT ASSEMBLY

CROSS-REFERENCE TO RELATED APPLICATION

This application claims the benefit of prior-filed, U.S. Provisional Patent Application No. 62/050,425, filed Sep. 15, 2014, the entire contents of which are incorporated by reference herein.

BACKGROUND

The present invention relates to mining machines. Specifically, the present invention relates to a service tool for a cutting bit assembly of a mining machine.

Conventional continuous mining and entry development machines include a cutter head including multiple cutting bit assemblies. In some embodiments, each cutting bit assembly includes a bit holder block coupled to a rotating drum. A water spray nozzle is positioned within the bit holder block, and the bit holder block includes a passage for providing water to the spray nozzle. The bit holder block also includes a slot for receiving a sleeve. The sleeve includes an outer surface engaging the slot of the bit holder block, and also includes a bore for receiving a cutting bit.

SUMMARY

In one aspect, a tool is provided for installing and removing a bit sleeve with respect to a bore of a bit block. The bit sleeve includes a shank and a bore for receiving a bit. The bit block bore defines a bore width. The tool includes an actuator assembly, a rod, a first nut, and a second nut. The actuator assembly includes a cylinder and a ram. The cylinder includes an internal chamber supporting the ram and configured to be in fluid communication with a fluid source. The cylinder includes a first end, a second end, and a reaction surface positioned proximate the first end. The reaction surface is configured to contact an end of the sleeve. The ram is movable relative to the cylinder and positioned adjacent the second end of the cylinder. The actuator assembly includes a bore extending through the cylinder and the ram. The rod includes a first end and a second end, and defines a rod axis extending between the first end and the second end. The rod extends through the bore of the actuator assembly, and a portion of the rod is configured to extend through the bore of the bit sleeve such that the first end is positioned adjacent an end surface of the shank. The second end of the rod is positioned adjacent the ram. The first nut is selectively coupled to one of the first end of the rod and the second end of the rod. The first nut defines a first dimension configured to be larger than the bore width of the bit block. The second nut is selectively coupled to the other of the first end of the rod and the second end of the rod, and the second nut defines a second dimension configured to be less than the bore width.

In another aspect, a method is provided for installing a bit sleeve into a bore of a bit block. The bit sleeve includes a first end, a second end, a shank positioned proximate the first end of the sleeve, and a bore extending from the first end to the second end. The bore of the bit block has a bore width. The method includes: inserting a first end of the rod through the sleeve bore and through the bore of the bit block; threading a first nut onto the first end of the rod such that the first nut engages a surface of the bit block, the first nut having a dimension that is larger than the bore width of the bit block; threading a second nut onto the second end of the rod such that the second nut engages a ram of an actuator assembly, the second nut releasably securing the ram against movement relative to the rod along a rod axis in at least a first direction; applying fluid pressure on the ram; and contacting the second end of the sleeve with a reaction surface to move the sleeve in a second direction along the rod axis and into the bore of the bit block.

In yet another aspect, a method is provided for removing a bit sleeve from a bore of a bit block. The bit sleeve includes a first end, a second end, a shank positioned proximate the first end of the sleeve, and a bore extending from the first end to the second end. The bore of the bit block having a bore width. The method includes: inserting a first end of the rod through the sleeve bore and through the bore of the bit block; threading a first nut onto the first end of the rod such that the first nut engages a surface of the bit block, the first nut having a dimension that is smaller than the bore width of the bit block; threading a second nut onto the second end of the rod such that the second nut engages a ram of an actuator assembly, the second nut releasably securing the ram against movement relative to the rod along a rod axis in at least a first direction; applying fluid pressure on the ram; and contacting an end of the shank with the first nut to move the sleeve in the first direction along the rod axis and out of the bore of the bit block.

In still another aspect, a tool is provided for moving a bit sleeve relative to a bore of a bit block. The bit sleeve includes a shank and a bore for receiving a bit. The bore of the bit block defines a bore width. The service tool includes an actuator assembly, a rod, at least one nut, and at least one elongated arm. The actuator assembly includes a cylinder and a ram. The cylinder includes an internal chamber supporting the ram, the internal chamber configured to be in fluid communication with a fluid source. The cylinder includes a first end and a second end. The ram is movable relative to the cylinder and positioned adjacent the second end of the cylinder. The actuator assembly includes a bore extending through the cylinder and the ram. The rod includes a first end and a second end, and the rod defines a rod axis extending between the first end and the second end. The rod extends through the bore of the actuator assembly. A portion of the rod is configured to extend through the bore of the bit sleeve such that the first end is positioned adjacent an end surface of the shank. The second end of the rod is positioned adjacent the ram. The at least one nut is selectively coupled to one of the first end of the rod and the second end of the rod. The at least one elongated arm extends in a direction parallel to the rod axis. The at least one arm is positioned proximate the first end of the cylinder and is rotatable relative to the cylinder about the rod axis.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or hydraulic connections or couplings, whether direct or indirect. Also, electronic communications and notifications may be performed using any known means including direct connections, wireless connections, etc.

Figure 1:
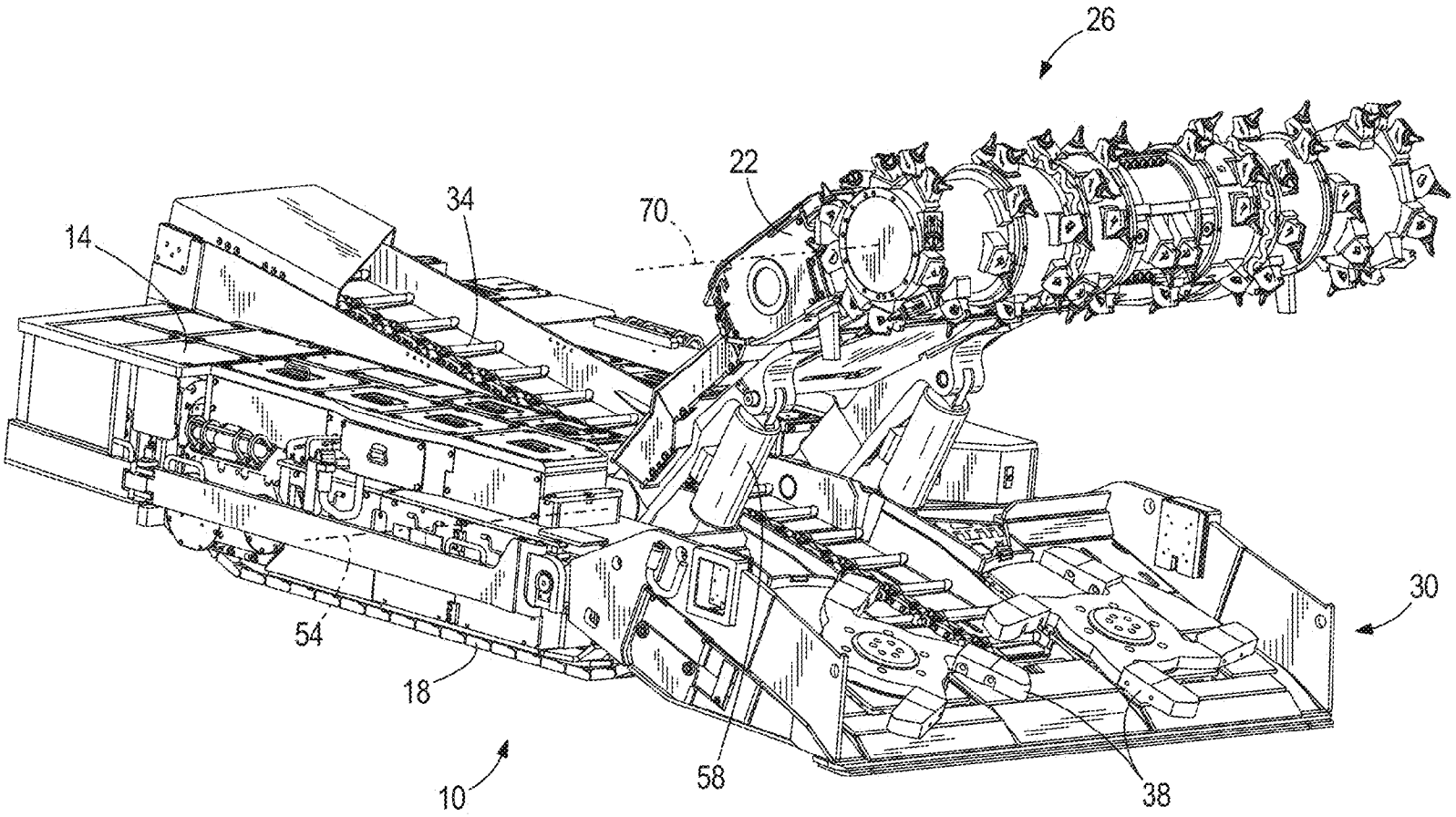
FIG. 1 is a perspective view of a mining machine.

FIG. 1 illustrates a mining machine, such as a continuous miner 10, including a frame 14 that is supported for movement by tracks 18. The continuous miner 10 further includes a boom 22 and a cutter head 26 supported on the boom 22. In the illustrated embodiment, the frame 14 also includes a gathering head 30 and a conveyor 34 extending from a first or front end of the frame 14 toward a second or rear end of the frame 14. The gathering head 30 includes a pair of rotating arms 38 that engage cut material below the cutter head 26 and direct the cut material onto the conveyor 34. The conveyor 34 transports the cut material along a longitudinal axis of the frame 14, from the area below the cutter head 26 to a second conveyor (not shown) positioned proximate the second end of the frame 14.

The boom 22 includes one end pivotably coupled to the frame 14 and another end supporting the cutter head 26. The boom 22 is pivotable about a pivot axis 54 that is generally transverse to the longitudinal axis of the frame 14. The boom 22 is pivoted by a pair of actuators 58 that are coupled between the frame 14 and the boom 22. In the illustrated embodiment, the actuators 58 are hydraulic jacks or cylinders.

Figure 2:
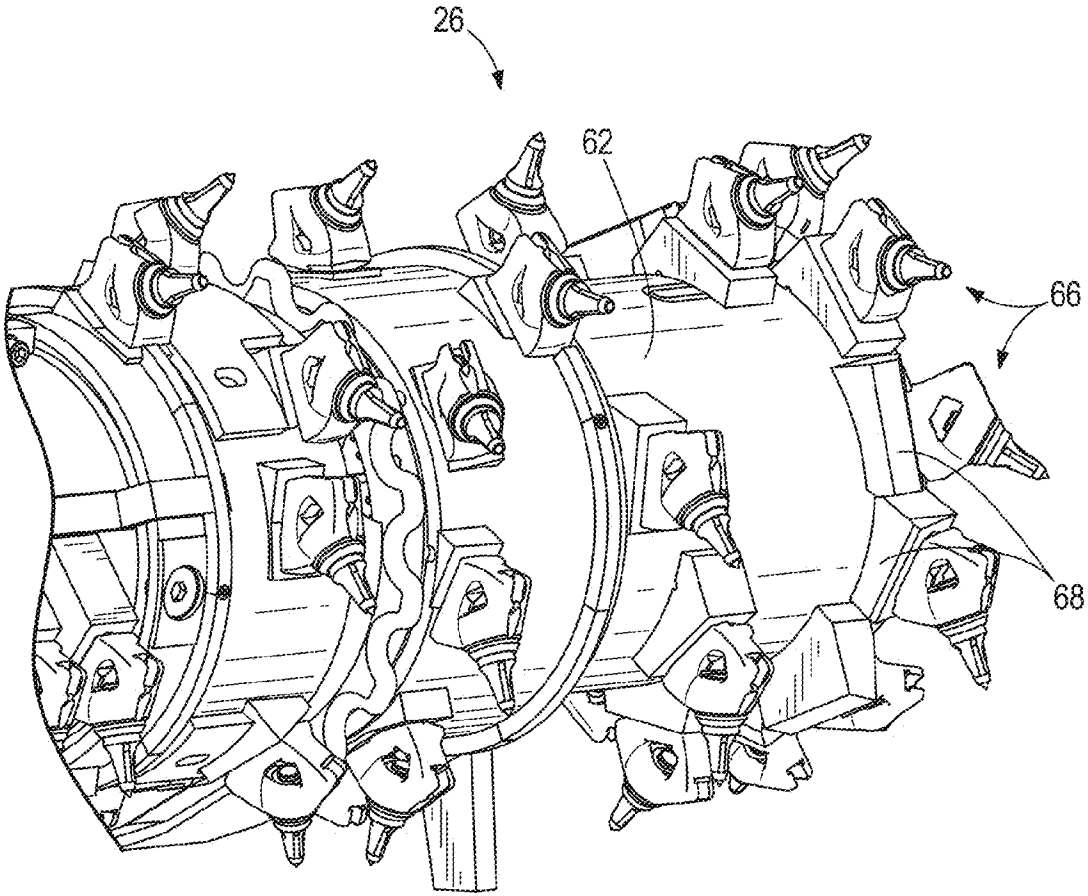
FIG. 2 is a perspective view of a portion of a cutter head.

Referring to FIG. 2, the cutter head 26 is formed as an elongated drum 62 including cutting bit assemblies 66 secured to an outer surface of the drum 62. In the illustrated embodiment, the outer surface of the drum 62 includes multiple pedestals 68, and each cutting bit assembly 66 is secured to one of the pedestals 68. The drum 62 defines a drum axis 70 (FIG. 1) that is generally parallel to the pivot axis 54 of the boom 22, and the drum 62 is rotatable about the drum axis 70.

Figure 3:
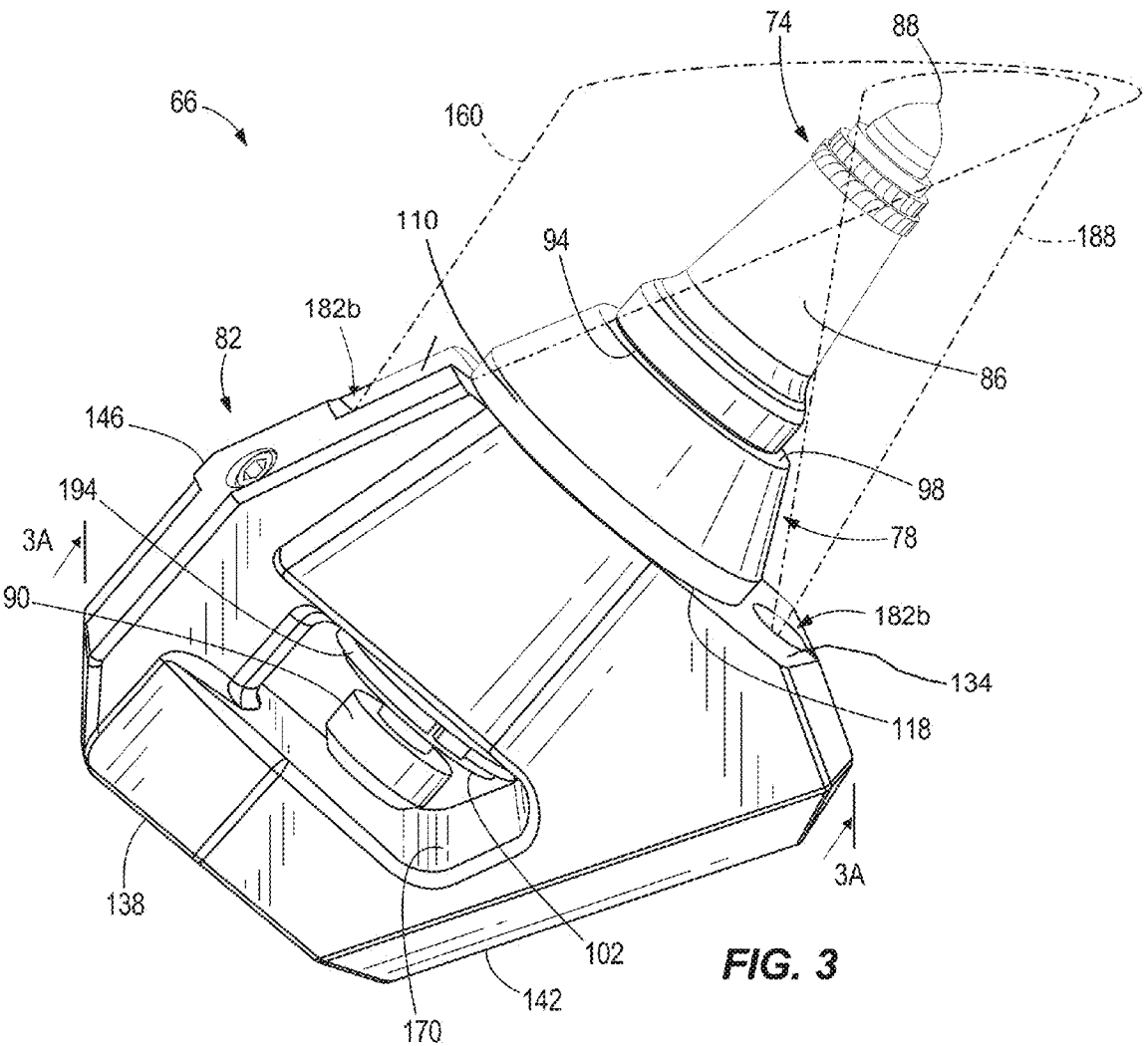
FIG. 3 is a perspective view of a cutting bit assembly.

Referring to FIG. 3, each cutting bit assembly 66 includes a bit 74, a sleeve 78, and a holder block 82. The bit 74 includes a first portion 86 having a tip 88 for engaging a mine face to remove material, and a second portion or shank. An end portion of the shank 90 is shown in FIG. 3. The first portion 86 defines a shoulder 94 adjacent the shank 90.

Figure 3A:
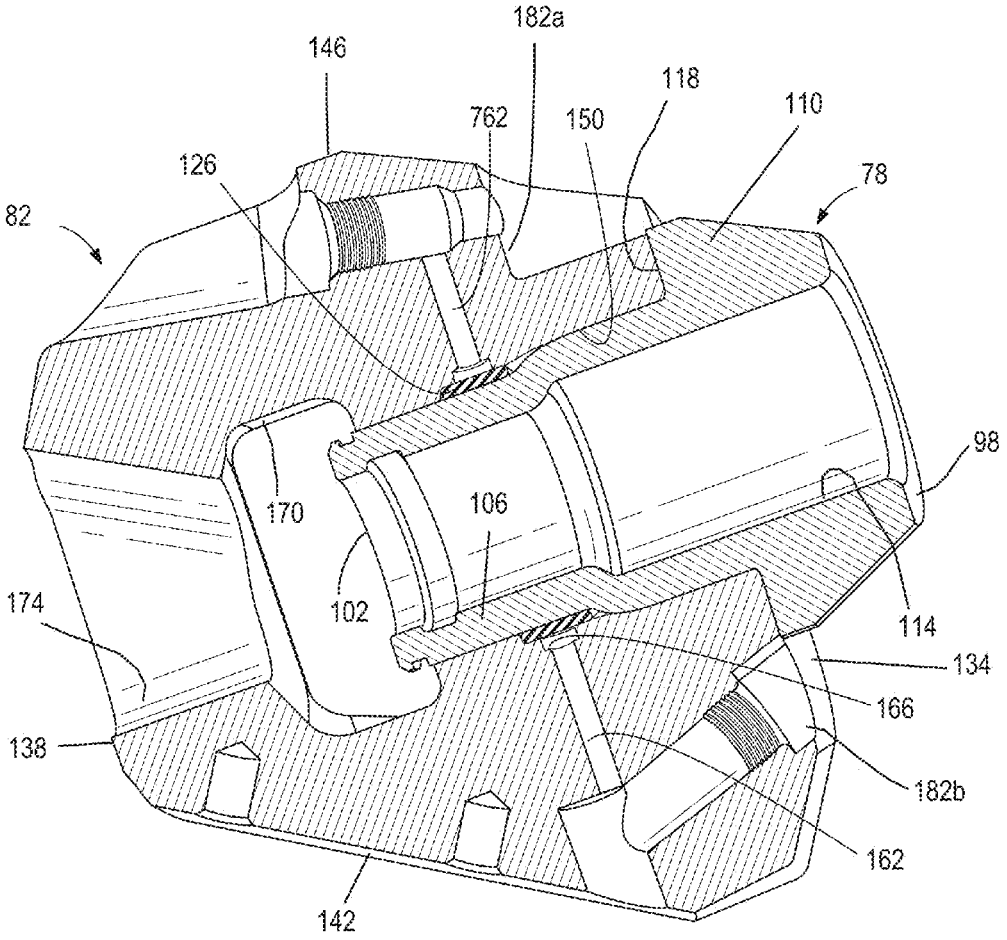
FIG. 3A is a section view of the cutting bit assembly of FIG. 3 with a bit removed, viewed along section 3A-3A.

Referring to FIG. 3A, the sleeve 78 defines a first end 98 and a second end 102, and the sleeve 78 includes a flange 110 and a bore 114 extending through the sleeve 78 from the first end 98 to the second end 102. The flange 110 is positioned adjacent the first end 98 of the sleeve 78 and defines an abutment surface 118. The shank 90 of the bit 74 (FIG. 3) is positioned within the bore 114, and the shoulder 94 (FIG. 3) abuts the first end 98 of the sleeve 78. In one embodiment, the shank 90 of the bit 74 is received in the bore 114 by a clearance fit and is retained by a pin or clip (not shown). In other embodiments, the shank 90 may be press fit within the bore 114. Other features of the sleeve 78 will be described below with respect to FIGS. 7 and 8.

The sleeve 78 further includes a shank portion 106 positioned within the bore 150 of the holder block 82. The shank portion 106 is inserted until the abutment surface 118 engages the front end surface 134 of the holder block 82. In one embodiment, the shank portion 106 is press fit within the holder block bore 150 and is further secured relative to the holder block 82 by a retaining ring or clip 194 (FIG. 3). The clip 194 may extend around a portion of the sleeve 78 extending into a lateral opening 170 of the holder block 82.

Referring again to FIGS. 3 and 3A, the holder block 82 defines a first or front end surface 134, a second or rear end surface 138, a third or lower surface 142, and a fourth or upper surface 146. The lower surface 142 is secured to the one of the pedestals 68 (FIG. 2). In the illustrated embodiment, the holder block 82 also includes a first or lateral opening 170 extending between sides of the holder block 82, and a bore 150 extending through the front end surface 134 to the lateral opening 170. Although each of the bore 150 of the block 82 and the bore 114 of the sleeve 78 has a generally circular cross-section, it is understood that in other embodiments the bore 114 and the bore 150 may have non-circular cross-sections. The block 82 also includes a second opening 174 extending between the rear end surface 138 and the lateral opening 170. The second opening 174 is capable of permitting broken portions of the bit 74 (FIG. 3) to be pushed through the rear end surface 138 of the holder block 82, or allowing another tool to be inserted through the second opening 174 to push the bit 74 through the front of the holder block 82.

In the illustrated embodiment, the holder block 82 includes a first or rear or upper recess 182*a* and a second or forward or lower recess 182*b*. A fluid spray nozzle (not shown) may be positioned within each recess 182*a*, 182*b*.

Each nozzle discharges fluid (e.g., water) in the form of a spray envelope that encompasses or covers an outer surface of the bit 74 proximate the tip 88. As shown in FIG. 3, in the illustrated embodiment, the nozzle in the upper recess 182*a* produces a first spray envelope 160, and the nozzle in the lower recess 182*b* produces a second spray envelope 188. The spray envelopes 160, 188 have a conical shape in the illustrated embodiment; in other embodiments, the envelopes may have a different shape.

The holder block 82 includes passages for providing fluid to the nozzles. As shown in FIG. 3A, in the illustrated embodiment, a linear passage 162 provides fluid communication between the lower nozzle and the upper nozzle, and an annular passage 166 extends around an outer surface of the shank portion 106. A seal 126 may extend around the shank portion 106 to seal the sleeve 78 against the fluid in the passage 166. In other embodiments, the fluid passages may be formed in another manner, and may not intersect the holder block bore 150; instead, the passages may be angled away from the holder block bore 150 and extend through the body of the holder block 82. Also, in other embodiments, the holder block 82 may include only one of the nozzles/recesses (e.g., only the upper nozzle and upper recess 182*a* without the lower nozzle and lower recess 182*b*).

Figure 4:
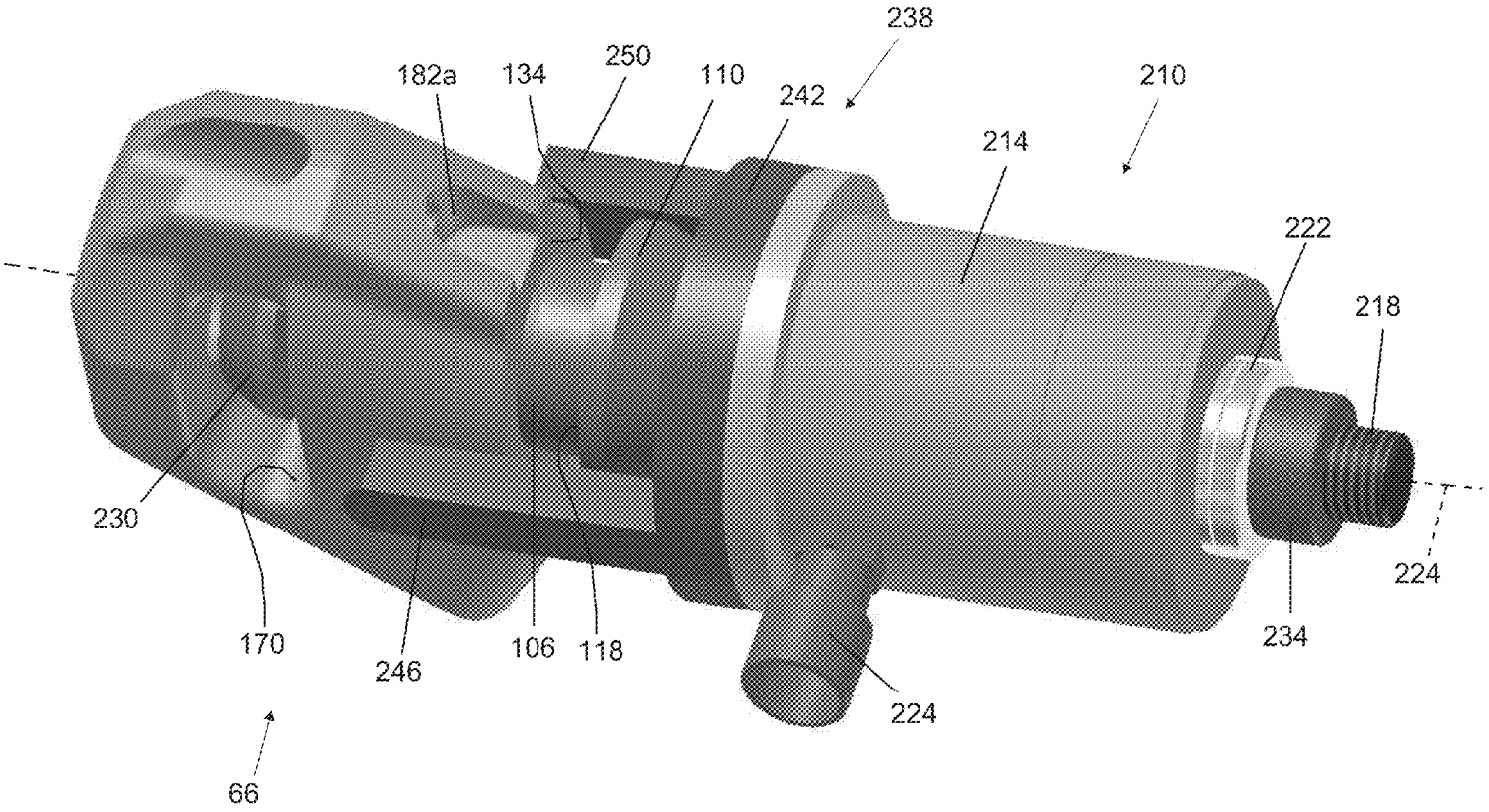
FIG. 4 is a perspective view of a service tool engaging a holder block and a sleeve.
Figure 5A:
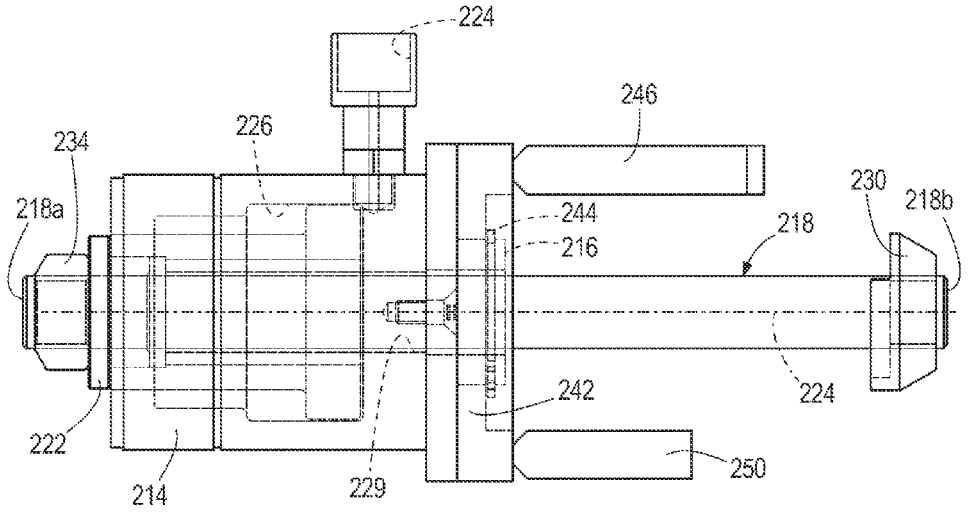
FIG. 5A is a side view of the service tool of FIG. 4.
Figure 5B:
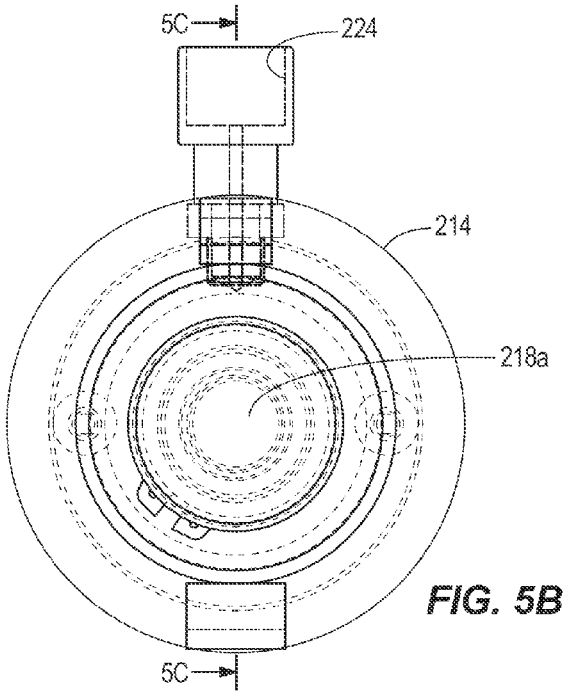
FIG. 5B is an end view of the service tool of FIG. 5A.
Figure 5C:
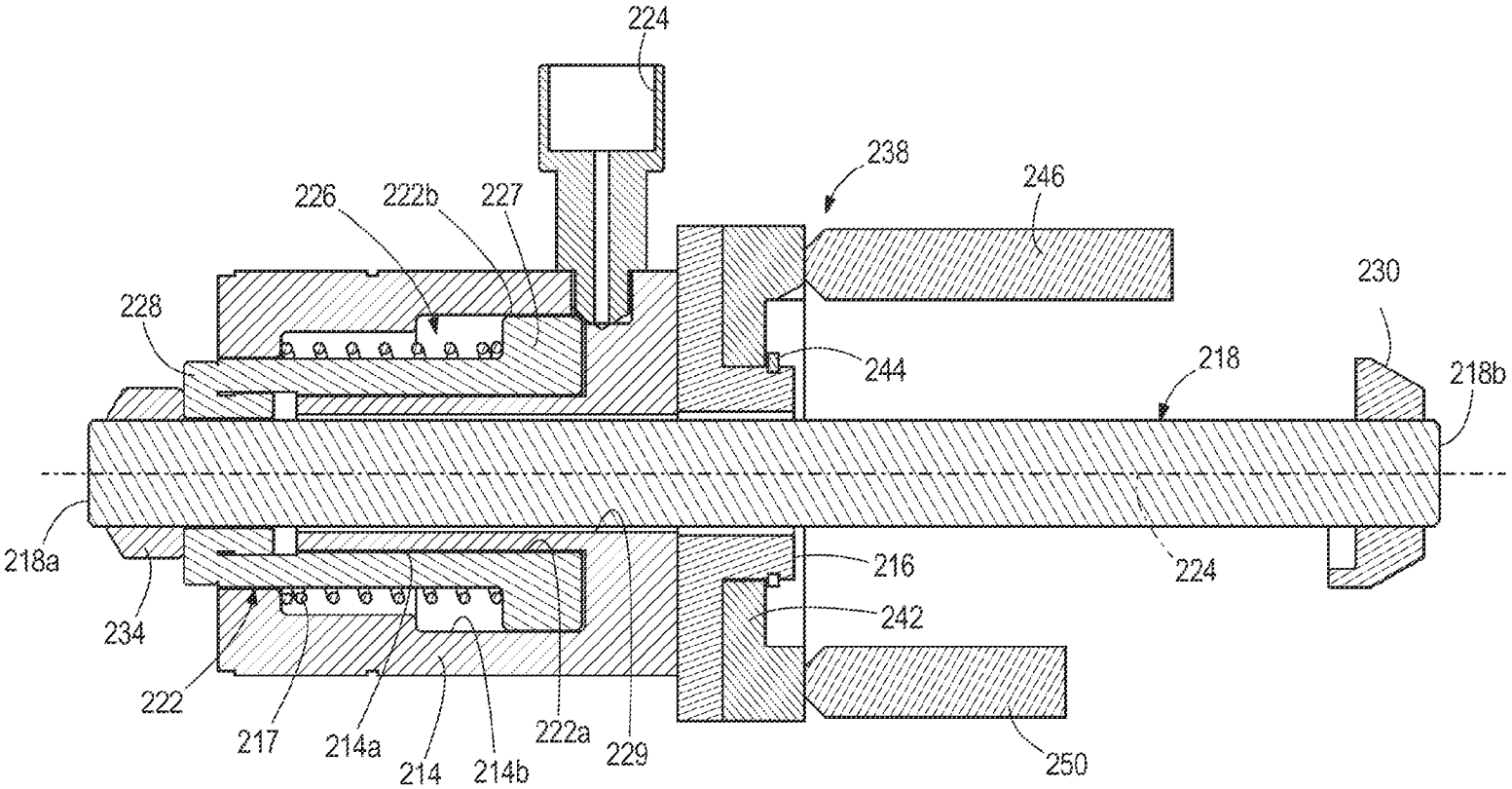
FIG. 5C is a section view of the service tool of FIG. 5B, viewed along section 5C-5C.
Figure 6A:
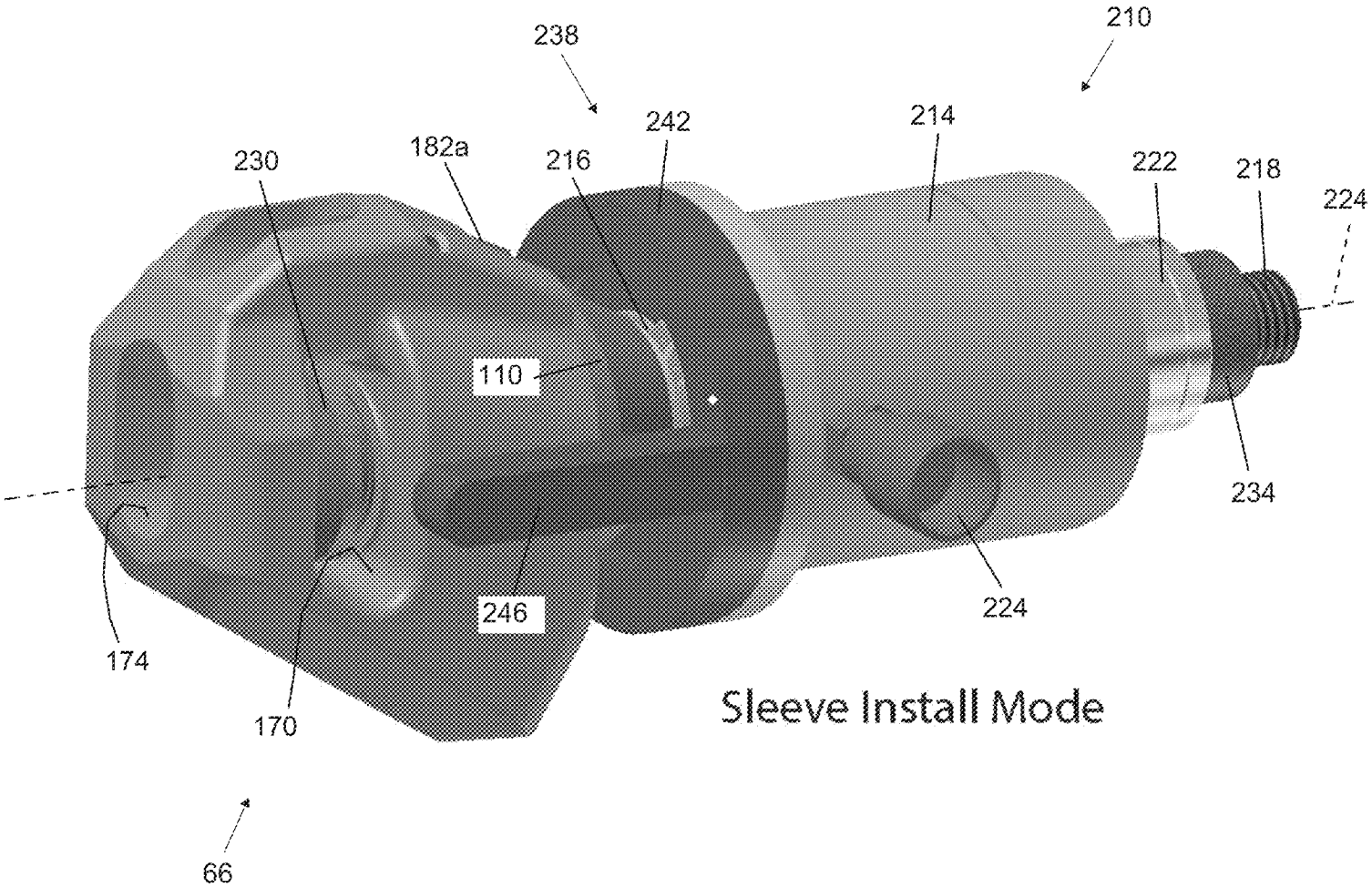
FIG. 6A is a perspective section view of the service tool of FIG. 5 installing a sleeve into a holder block.
Figure 6B:
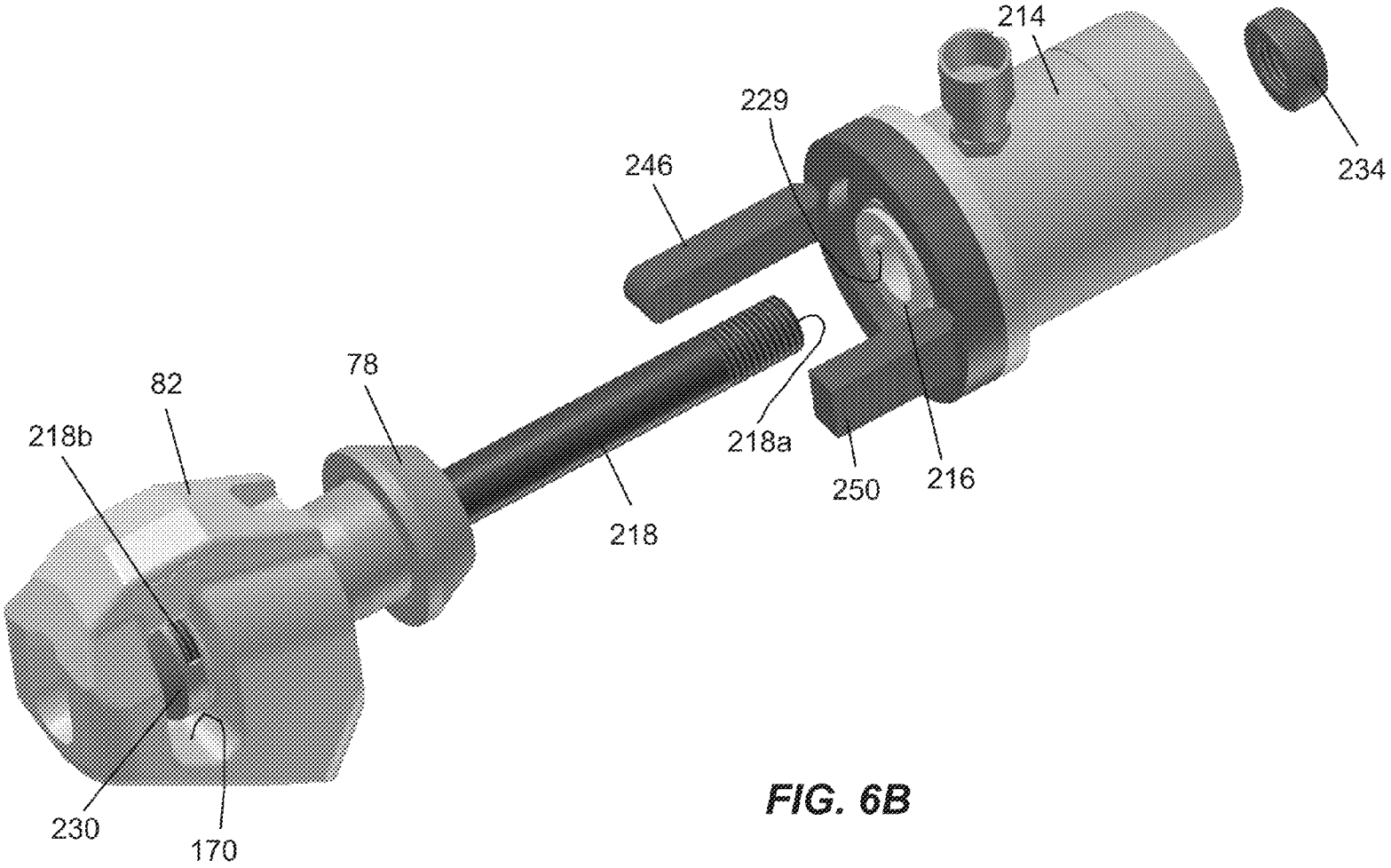
FIG. 6B is a partial exploded view of the service tool, the sleeve, and the holder block of FIG. 6A.

FIGS. 4-5C illustrate a service tool 210 for installing and removing the sleeve 78 (FIG. 4) with respect to the holder block 82. The service tool 210 includes a fluid cylinder 214 and ram 222, a reaction surface 216 (FIGS. 5A-5C) positioned on one end of the cylinder 214, and a rod 218 extending through the cylinder 214. The cylinder 214 includes a port 220 in fluid communication with a pressurized fluid source (e.g., a hydraulic hand pump—not shown). In one embodiment, the cylinder 214 and ram 222 form an actuator assembly.

As best shown in FIG. 5C, the cylinder 214 defines an internal chamber 226 and the ram 222 is received within the chamber 226. The ram 222 includes a piston 227 and an outer surface 228. The port 220 provides pressurized fluid to one side of the piston 227 to extend the piston 227 relative to the cylinder 214. In the illustrated embodiment of FIG. 5C, the pressurized fluid moves the ram 222 to the left. A biasing member (e.g. a coil spring 217) is positioned on the other side of the piston 227 from the port 220 and applies a biasing force on the piston 227 to return the ram 222 to an initial position (FIG. 5C). An open bore 229 extends through the cylinder 214 and the ram 222. The ram 222 includes inner and outer seals (not shown) that engage an inner wall 222*a* and an outer wall 222*b* of the piston 227 against an inner wall 214*a* and an outer wall 214*b*, respectively, of the cylinder 214. The seals prevent fluid from leaking into the bore 229.

The rod 218 extends through the bore 228 such that a first end 218*a* is positioned adjacent the outer surface 228 of the ram 222 and a second end 218*b* is positioned adjacent the reaction surface 216. The rod 218 defines an axis 224. The tool 210 further includes a first nut 230 threadingly coupled to one end of the rod 218 and a second nut 234 threadingly coupled to an opposite end of the rod 218. In the illustrated embodiment, the rod 218 is removably coupled to the ram 22 by positioning the rod 218 in the bore 229 and threading one of the nuts 230, 234 onto the first end 218*a* of the rod 218 to engage the outer surface 228 of the ram 222. This engagement releasably secures the rod 218 against movement independent of the ram 222 in at least one direction along the rod axis 224.

In the illustrated embodiment, the first nut 230 has an outer dimension or diameter larger than the width or diameter of the holder block bore 150. The second nut 234 has an outer dimension or diameter that is smaller than the width or diameter of the bore 150, or no greater than the outer diameter of the shank portion 106. The first nut 230 and the second nut 234 may be selectively coupled to either end of the rod 218, but the nuts 230, 234 are not coupled to the same end during operation. In particular, the nut that is threaded onto the first end 218*a* of the rod 218 secured the rod 218 relative to the ram 222, such that the rod 218 moves with the ram 222 when it extends due to fluid pressure in the internal chamber 226.

The tool 210 also includes a swivel assembly 238 rotatably coupled to the end of the cylinder 214 proximate the reaction surface 216. The swivel assembly 238 includes a hub 242, a first arm 246, and a second arm 250. The hub 242 is coupled to the reaction surface 216 and secured against movement along the rod axis 224 by a retainer 244 (e.g., a snap ring) engaging a recess of the hub 242. The hub 242 can rotate about the rod axis 224 relative to the reaction surface 216. The hub 242 extends around the reaction surface 216. In the illustrated embodiment, the arms 246, 250 are coupled to an outer perimeter of the hub 242, and the first arm 246 is longer than the second arm 250. The arms 246, 250 extend in a direction parallel to the axis 224 and are positioned on opposite sides of the axis 224 such that the arms 246, 250 are spaced apart by an angle of 180 degrees about the axis 224. In other embodiments, the swivel assembly 238 may include fewer or more arms 246, the arms 246 may have different shapes and/or relative lengths, and/or the arms 246 may be arranged in a different manner relative to the axis 224.

Figure 7:
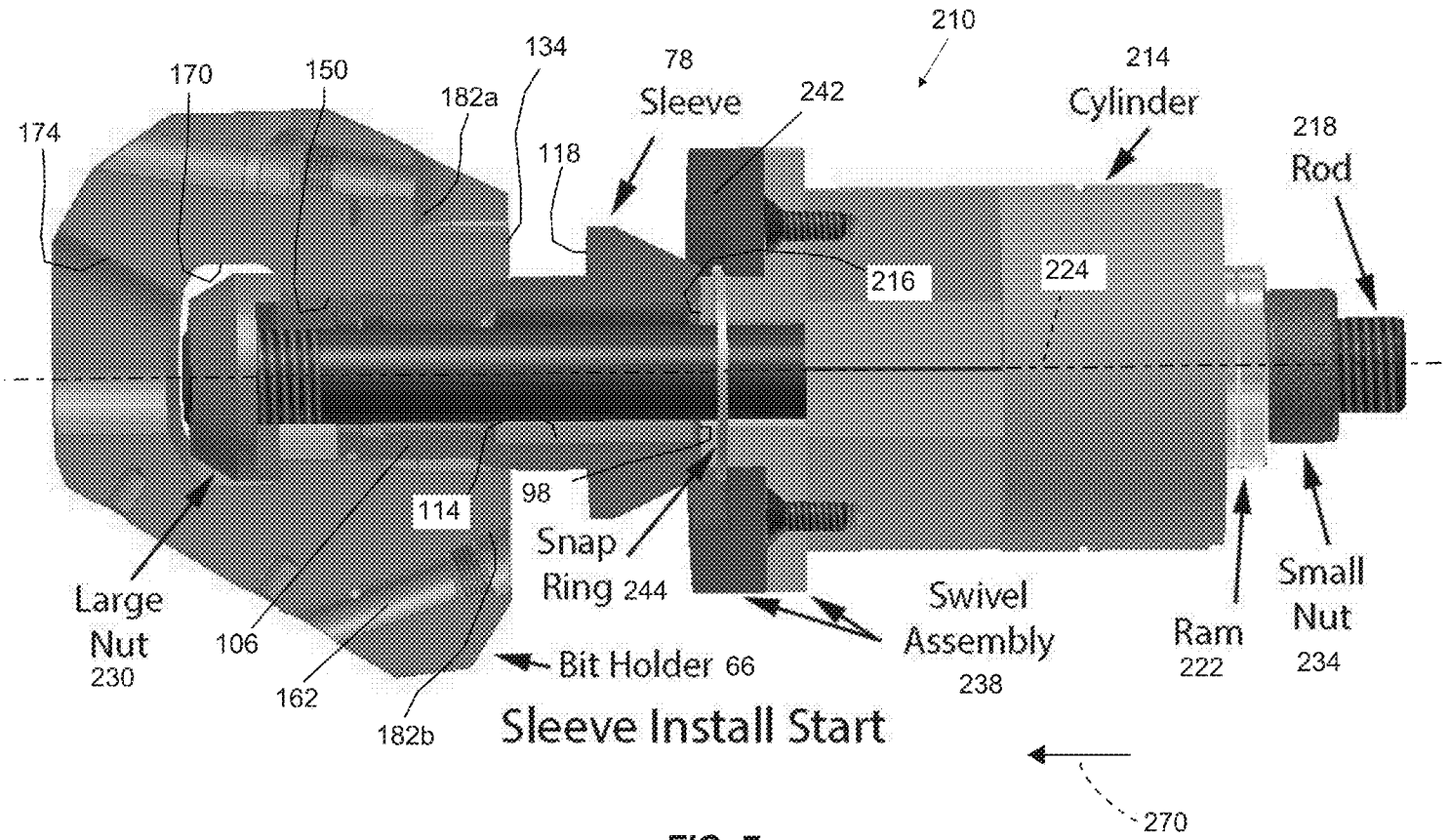
FIG. 7 is a side view of the service tool of FIG. 6A and during a first stage of installing the sleeve.

FIGS. 6-8 and 12B illustrate a process for inserting the sleeve 78 into the bore 150 of the holder block 82. Before inserting the sleeve 78, a thin coating of lubricant may be applied to the outer surface of the shank 106 and/or the bore 150 of the block 82. As shown in FIG. 6A, the swivel assembly 238 is oriented such that the arms 246, 250 are positioned adjacent the sides of the holder block 82. FIG. 6B illustrates an initial preparation stage for the insertion process. Because the rod 218 is separable from the cylinder 214 and ram 222, initially the second end 218*b* of the rod 218 is inserted through the bore 114 (FIG. 7) of the sleeve 78 and through the bore 150 of the holder block 82, such that the second end 218*b* is positioned in the lateral opening 170. The first nut 230 is threaded onto the second end of the rod 218*a* in the opening 170. As shown in FIG. 7, the cylinder 214 and ram 222 are then slid over the first end 218*a* of the rod 218 such that the first end 218*a* passes through the bore 229. The second nut 234 is coupled to the first end 218*a* of the rod 218 to secure the rod 218 and the ram 222 together.

Figure 8:
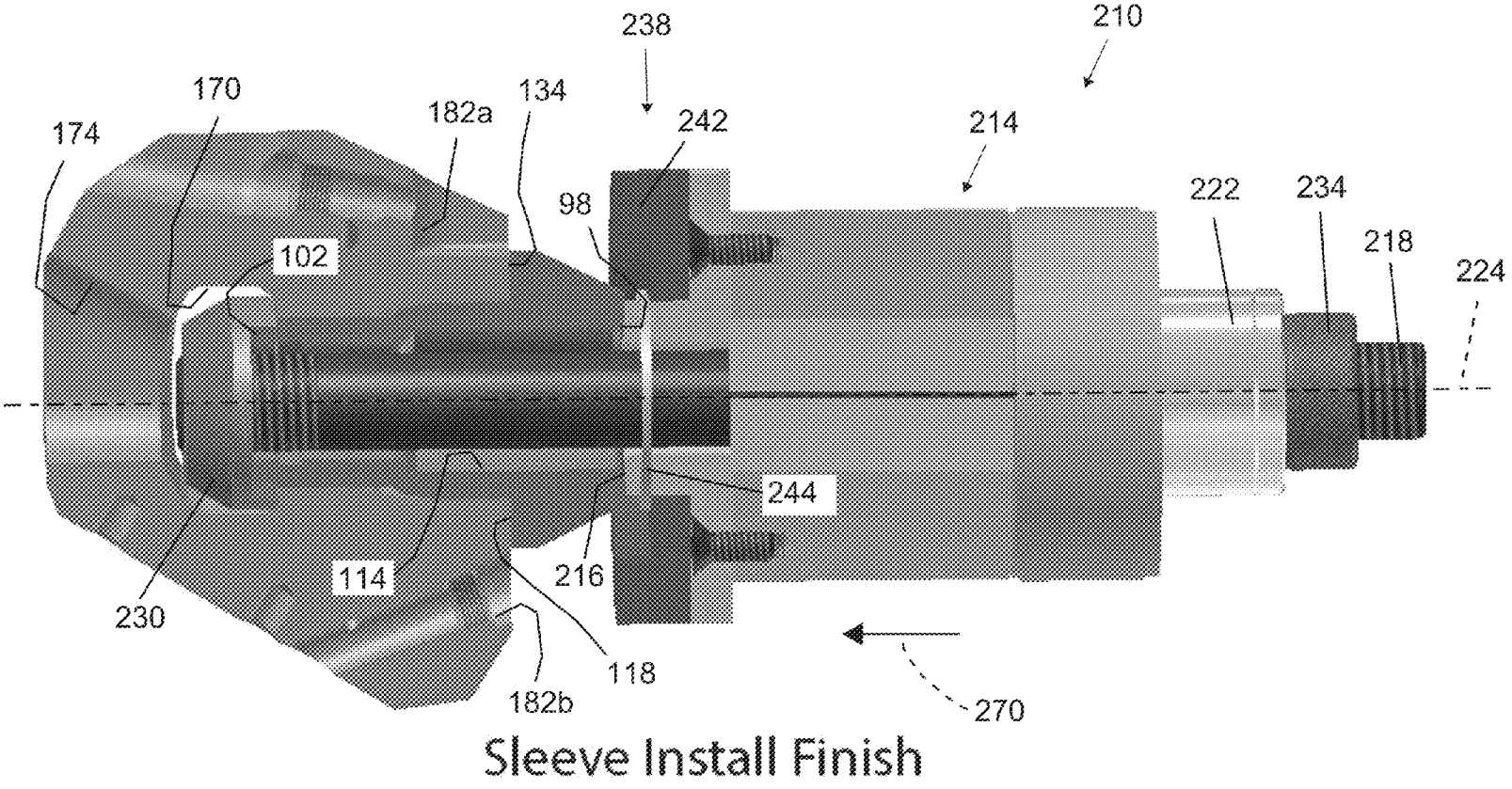
FIG. 8 is a side view of the service tool of FIG. 6A and a cutting bit assembly during a second stage of installing a sleeve.

Referring to FIG. 8, the first nut 230 is larger than the bore 150 of the holder block 82. In the illustrated embodiment, the first nut 230 engages a surface of the holder block 82 positioned at least partially in the lateral opening 170 and adjacent the opening of the holder block bore 150. The ram 222 is fixed relative to the rod 218 by the second nut 234, and the rod 218 is fixed relative to the block 82 by the first nut 230. When pressurized fluid is supplied to the cylinder 214, the first nut 230 and the holder block 82 exert a reaction force that is transmitted to the ram 222. The net force 270 caused by the fluid pressure moves the cylinder 214 along the axis 224 relative to the piston 227 and rod 218, drawing the cylinder 214 toward the first nut 230 threaded on the second end 218*a*. The reaction surface 216 contacts the first end 98 of the sleeve 78. The force 270 acting on the cylinder 214 moves the sleeve 78 along the axis 224 toward the first nut 230 (e.g., to the left in FIG. 8). The shank portion 106 of the sleeve 78 is inserted into the bore 150 of the holder block 82 until the abutment surface 118 engages the front end surface 134 of the block 82. When the pressure is reduced, the spring 217 returns the ram 222 to its initial position.

FIGS. 9-11 and 12A illustrate a process for extracting the sleeve 78 from the holder block 82. First, the clip 194 (FIG. 4) is removed from the shank 106 of the sleeve 78, and any debris in the recesses 182 is removed. As shown in FIG. 9A, the swivel assembly 238 is oriented such that the arms 246, 250 engage the holder block 82 to secure the cylinder 214 against movement relative to the block 82 along the axis 224. In the illustrated embodiment, the first arm 246 is at least partially positioned in the upper recess 182*a* of the block 82 and the end of the second arm 250 is positioned against the front end surface 134. In other embodiments, the second arm 250 may be at least partially positioned in the lower recess 182*b*.

Figure 9A:
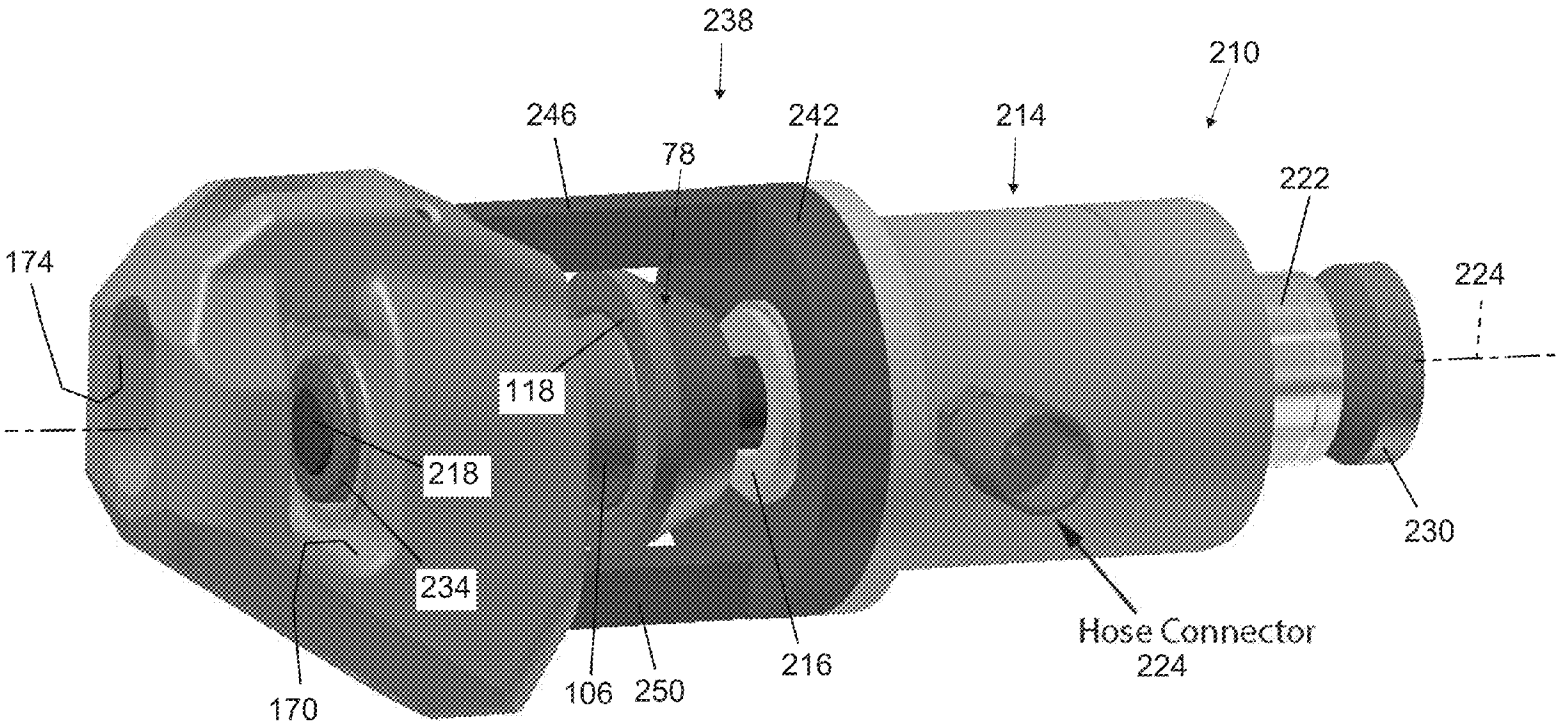
FIG. 9A is a perspective view of the service tool of FIG. 5 extracting a sleeve from a holder block.
Figure 9B:
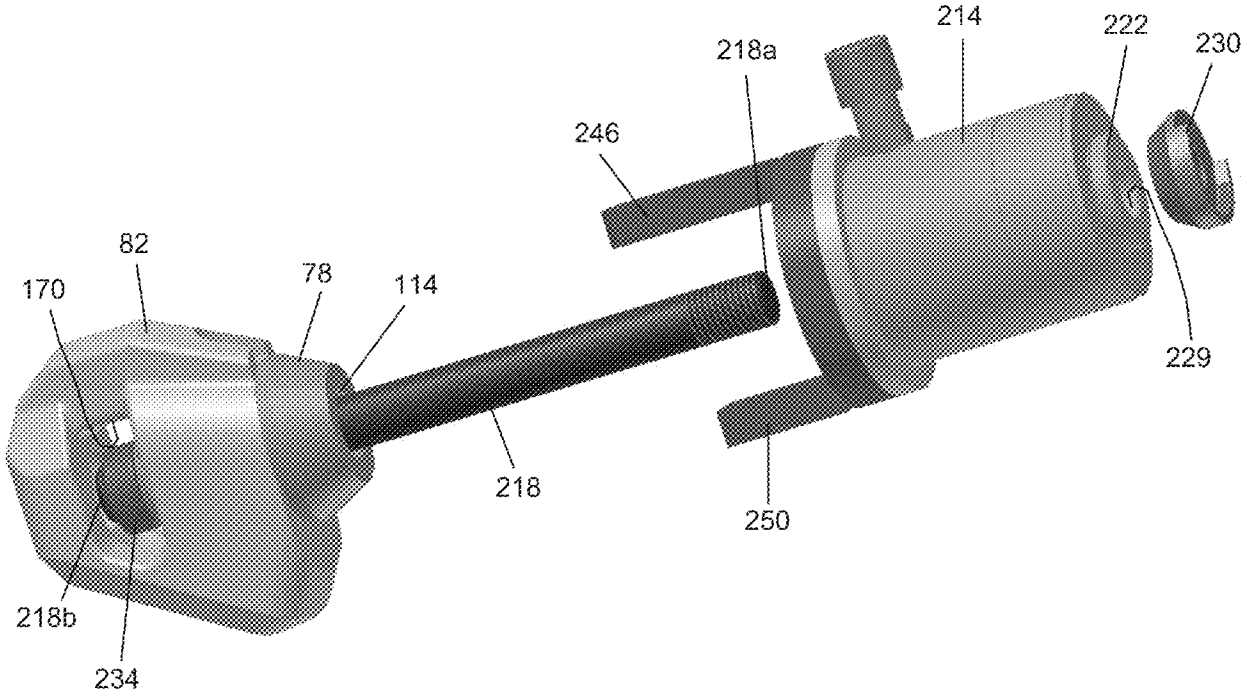
FIG. 9B is a partial exploded view of the service tool, the sleeve, and the holder block of FIG. 9A.
Figure 10:
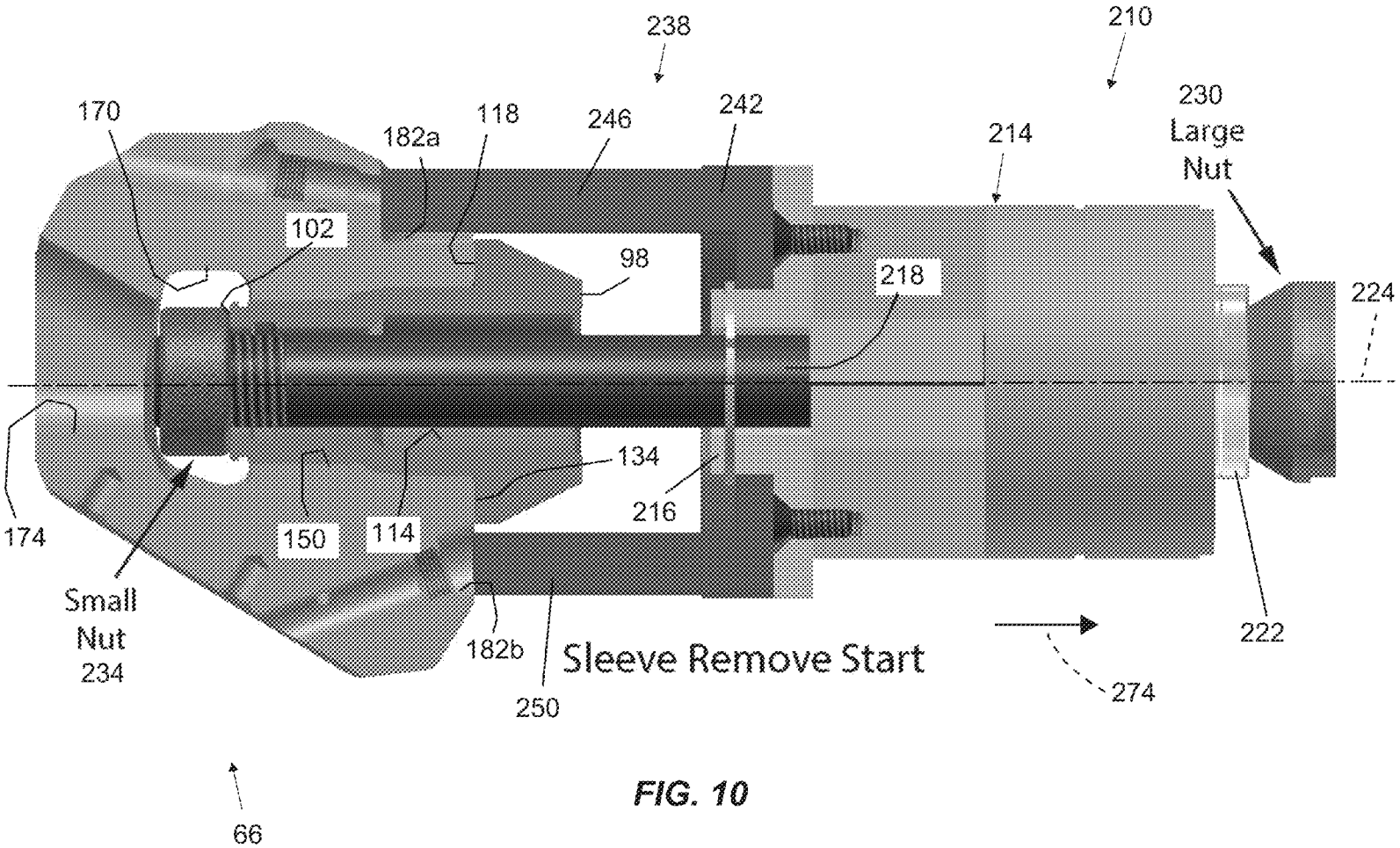
FIG. 10 is a side section view of the service tool of FIG. 9A and a cutting bit assembly during a first stage of extracting a sleeve.

FIG. 9B illustrates an initial preparation stage for the extraction process. As noted above, the rod 218 is separable from the cylinder 214 and ram 222. Initially, the second end 218*b* of the rod 218 is inserted through the sleeve 78 and through the holder block 82, such that the second end 218*b* is positioned in the lateral opening 170. The second nut 234 is threaded onto the second end of the rod 218*a* in the opening 170. As shown in FIG. 10, the cylinder 214 and ram 222 are then slid over the first end 218*a* of the rod 218 such that the first end 218*a* passes through the bore 229. The first nut 230 is coupled to the first end 218*a* of the rod 218 to secure the rod 218 and the ram 222 together.

Figure 11:
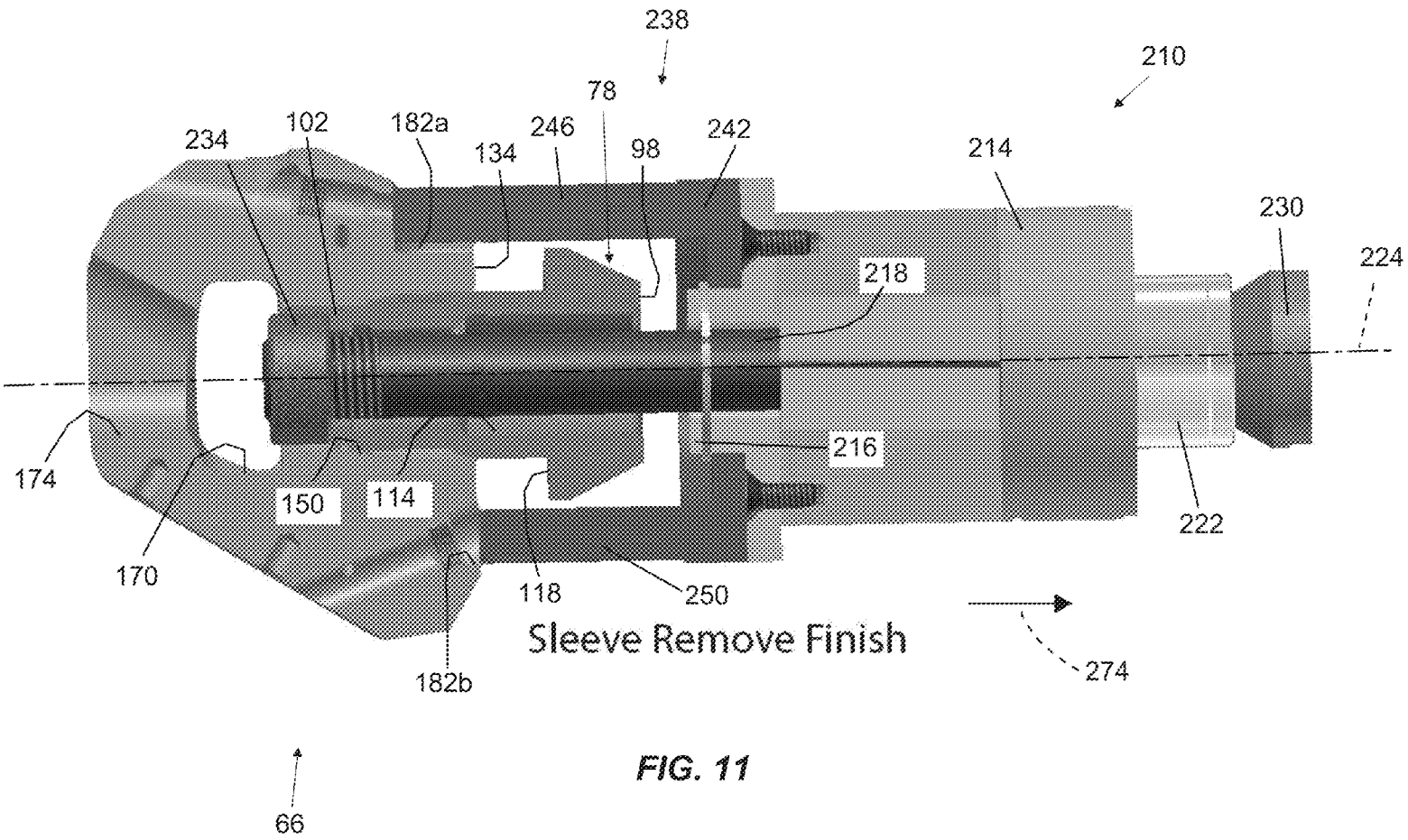
FIG. 11 is a side section view of the service tool of FIG. 9A and a cutting bit assembly during a second stage of extracting a sleeve.
Figure 12A:
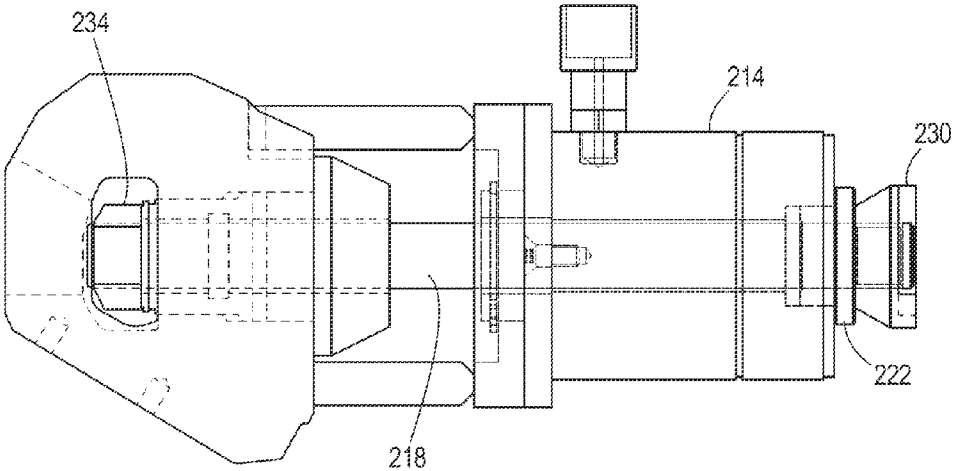
FIG. 12A is a side view of the service tool, a holder block and a bit sleeve during removal of the sleeve from the holder block.
Figure 12B:
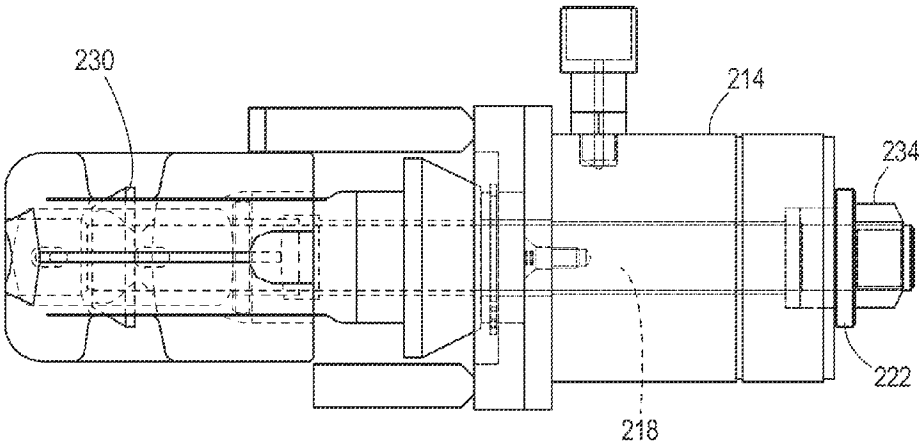
FIG. 12B is a side view of the service tool, a holder block and a bit sleeve during installation of the sleeve into the holder block.

Referring to FIG. 11, the second nut 234 has a dimension or diameter that is no greater than the outer diameter of the sleeve shank 106 (or at least, the diameter of the second nut 234 is smaller than the width of the holder block bore 150) and is sufficient to engage the second end 102 of the sleeve 78. The ram 222 is fixed relative to the rod 218 by the first nut 230, and the arms 246, 250 fix the cylinder 214 relative to the block 82. When pressurized fluid is supplied to the cylinder 214, the arms 246, 250 exert a reaction force on the holder block 82. The net force 274 caused by the fluid pressure moves the rod 218 along the rod axis 224 relative to the cylinder 214. The force 274 on the ram 222 is transmitted by the second nut 234 to the second end 102 of the sleeve 78 to move the sleeve 78 along the axis 224 and out of the holder block bore 150 (e.g., to the right in FIG. 11). When the pressure is reduced, the spring 217 returns the ram 222 to its initial position.

The rod 218 can be easily uncoupled from the actuator cylinder 214 and the ram 222 by unthreading a nut from the first end 218*a*. As a result, the rod 218 can be inserted into the sleeve 78 and the bore of the block and threaded with one of the nuts 230, 234 without requiring the user to handle and align the entire tool to prepare for the installation or extraction processes. The cylinder 214 and ram 222 can simply slide over the rod 218 and secured with a nut threaded onto the first end 218*a*. In addition, the ability to rotate the arms 246, 250 provides versatility and ease of use for the tool 10.

The ram 222 and cylinder 214 of the tool 210 are single-acting in that pressurized fluid moves the ram 222 is one direction only relative to the cylinder 214 (e.g. to an extended position relative to the cylinder 214), and the ram 222 returns to its initial position under the biasing force of the spring 217. In other embodiments, the tool 210 may include a double-acting piston and cylinder device.

Although the cutting bit assembly 66 has been described above with respect to a continuous mining machine, it is understood that the cutting bit assembly 66 could be incorporated onto various types of cutter heads and various types of mining machines including, but not limited to, entry development machines and longwall shearers.

Although certain aspects have been described in detail with reference to certain preferred embodiments, variations and modifications exist within the scope and spirit of one or more independent aspects as described.

We claim:

1. A tool for installing and removing a bit sleeve with respect to a bore of a bit block, the bit sleeve including a shank and a bore for receiving a bit, the bit block bore defining a bore width, the tool comprising:

an actuator assembly including a cylinder and a ram, the cylinder including an internal chamber supporting the ram and configured to be in fluid communication with a fluid source, the cylinder including a first end, a second end, and a reaction surface positioned proximate the first end, the reaction surface configured to contact an end of the sleeve, the ram movable relative to the cylinder and positioned adjacent the second end of the cylinder, the actuator assembly including a bore extending through the cylinder and the ram;

a rod including a first end and a second end, the rod defining a rod axis extending between the first end and the second end, the rod extending through the bore of the actuator assembly, a portion of the rod configured to extend through the bore of the bit sleeve such that the first end is positioned adjacent an end surface of the shank, the second end of the rod positioned adjacent the ram;

a first nut selectively coupled to one of the first end of the rod and the second end of the rod, the first nut defining a first dimension configured to be larger than the bore width of the bit block; and a second nut selectively coupled to the other of the first end of the rod and the second end of the rod, the second nut defining a second dimension configured to be less than the bore width.

2. The tool of claim 1, wherein the first nut is coupled to the first end of the rod and the second nut is coupled to the second end of the rod in a first configuration, wherein the second nut releasably secures the ram against movement relative to the rod in at least a first direction along the rod axis.

3. The tool of claim 2, wherein the first nut is configured to engage a surface of the bit block, wherein applying fluid pressure on the ram causes the cylinder to move relative to the rod along the rod axis in a second direction opposite the first direction, the reaction surface configured to engage and move the sleeve along the rod axis in the second direction.

4. The tool of claim 2, wherein the first nut is coupled to the second end of the rod and the second nut is coupled to the first end of the rod in a second configuration, wherein the first nut releasably secures the ram against movement relative to the rod in at least the first direction along the rod axis.

5. The tool of claim 4, wherein, in the second configuration, the second nut is configured to engage an end surface of the shank without contacting the bit block, wherein applying fluid pressure on the ram causes the rod to move relative to the cylinder along the rod axis in the first direction, the rod and the second nut configured to move the shank along the rod axis in the first direction away from the bit block.

6. The tool of claim 1, further comprising at least one arm extending in a direction parallel to the rod axis, the arm configured to engage a surface of the block to secure the cylinder against movement along the rod axis.

7. The tool of claim 6, wherein the at least one arm is positioned proximate the first end of the cylinder and is rotatable relative to the cylinder about the rod axis.

8. The tool of claim 6, wherein the at least one arm includes a pair of arms spaced apart by an angle of 180 degrees about the rod axis.

9. The tool of claim 8, wherein the pair of arms is rotatable between a first position in which an end of each arm is configured to contact the holder block and a second position in which each arm is configured to be positioned along a side surface of the holder block.

10. A method for installing a bit sleeve into a bore of a bit block, the bit sleeve including a first end, a second end, a shank positioned proximate the first end of the sleeve and a bore extending from the first end to the second end, the bore of the bit block having a bore width, the method comprising:

inserting a first end of the rod through the sleeve bore and through the bore of the bit block;

threading a first nut onto the first end of the rod such that the first nut engages a surface of the bit block, the first nut having a dimension that is larger than the bore width of the bit block;

threading a second nut onto the second end of the rod such that the second nut engages a ram of an actuator assembly, the second nut releasably securing the ram against movement relative to the rod along a rod axis in at least a first direction;

applying fluid pressure on the ram; and contacting the second end of the sleeve with a reaction surface to move the sleeve in a second direction along the rod axis and into the bore of the bit block.

11. The method of claim 10, further comprising, prior to threading the second nut, sliding the actuator assembly onto the second end of the rod such that the rod extends through a bore passing through the ram.

12. The method of claim 10, wherein the actuator assembly includes a cylinder supporting the ram for movement relative to the cylinder, wherein applying the fluid pressure on the ram causes the cylinder to move relative to the rod and ram along the rod axis in the second direction.

13. The method of claim 12, wherein contacting the second end of the sleeve includes contacting the second end of the sleeve with a reaction surface positioned on an end of the cylinder proximate the sleeve, the cylinder moving the sleeve in the second direction and into the bore of the bit block.

14. The method of claim 10, further comprising positioning a pair of arms such that each arm extends along a side surface of the bit block and does not engage the bit block, wherein the pair of arms are pivotably coupled to the actuator assembly.

15. A method for removing a bit sleeve from a bore of a bit block, the bit sleeve including a first end, a second end, a shank positioned proximate the first end of the sleeve and a bore extending from the first end to the second end, the bore of the bit block having a bore width, the method comprising:

inserting a first end of the rod through the sleeve bore and through the bore of the bit block;

threading a first nut onto the first end of the rod such that the first nut engages a surface of the bit block, the first nut having a dimension that is smaller than the bore width of the bit block;

threading a second nut onto the second end of the rod such that the second nut engages a ram of an actuator assembly, the second nut releasably securing the ram against movement relative to the rod along a rod axis in at least a first direction;

applying fluid pressure on the ram; and contacting an end of the shank with the first nut to move the sleeve in the first direction along the rod axis and out of the bore of the bit block.

16. The method of claim 15, further comprising, prior to threading the second nut, sliding the actuator assembly onto the second end of the rod such that the rod extends through a bore passing through the ram.

17. The method of claim 15, further comprising, prior to applying fluid pressure, positioning a pair of arms such that each arm engages the bit block to secure the actuator assembly against movement relative to the block, wherein the pair of arms are pivotably coupled to the actuator assembly.

18. A tool for moving a bit sleeve relative to a bore of a bit block, the bit sleeve including a shank and including a bore for receiving a bit, the bore of the bit block defining a bore width, the tool comprising:

an actuator assembly including a cylinder and a ram, the cylinder including an internal chamber supporting the ram, the internal chamber configured to be in fluid communication with a fluid source, the cylinder including a first end and a second end, the ram movable relative to the cylinder and positioned adjacent the second end of the cylinder, the actuator assembly including a bore extending through the cylinder and the ram;

a rod including a first end and a second end, the rod defining a rod axis extending between the first end and the second end, the rod extending through the bore of the actuator assembly, a portion of the rod configured to extend through the bore of the bit sleeve such that the first end is positioned adjacent an end surface of the shank, the second end of the rod positioned adjacent the ram;

at least one nut selectively coupled to one of the first end of the rod and the second end of the rod; and at least one elongated arm extending in a direction parallel to the rod axis, the at least one arm positioned proximate the first end of the cylinder and rotatable relative to the cylinder about the rod axis.

19. The tool of claim 18, wherein the at least one arm includes a pair of arms spaced apart by an angle of 180 degrees about the rod axis.

20. The tool of claim 19, wherein the pair of arms is rotatable between a first position in which an end of each arm is configured to engage the holder block and a second position in which each arm is configured to be positioned along a side surface of the holder block.

21. The tool of claim 18, wherein the rod is secured against movement relative to the ram with the at least one nut is coupled to the second end of the rod.

22. The tool of claim 18, wherein the at least one nut includes a first nut selectively coupled to one of the first end of the rod and the second end of the rod and a second nut selectively coupled to the other of the first end of the rod and the second end of the rod, the first nut having a first dimension that is configured to be larger than the bore width of the bore of the bit block, the second nut having a second dimension that is configured to be less than the bore width, wherein, when the first nut is coupled to the first end of the rod, the at least one arm is in a first position in which the arm is configured to extend along a side surface of the bit block, wherein, when the first nut is coupled to the second end of the rod, the at least one arm is in a second position in which the arm is configured to engage a surface of the bit block.

* * * * *